United States Patent [19]

Matheis

[11] 4,378,070

[45] Mar. 29, 1983

[54] ARTICLE SUPPORTING RACK

[76] Inventor: James M. Matheis, 72 E. Charlotte Cir., Memphis, Tenn. 38117

[21] Appl. No.: 193,841

[22] Filed: Oct. 3, 1980

[51] Int. Cl.[3] ..... A47F 5/00

[52] U.S. Cl. ..... 211/86; 211/134; 211/135

[58] Field of Search ..... 211/87, 90, 103, 187, 211/188, 134, 135, 34; 108/111

[56] References Cited

U.S. PATENT DOCUMENTS

| | | | |
|---|---|---|---|
| 1,356,014 | 10/1920 | Reed | 211/87 |
| 1,492,188 | 4/1924 | Young | 211/135 X |
| 1,984,827 | 12/1934 | Derman | 211/87 X |
| 2,152,192 | 3/1939 | Hoffman . | |
| 2,232,916 | 2/1941 | Hillman | 211/134 X |
| 2,528,807 | 11/1950 | Whitney . | |
| 2,635,027 | 4/1953 | Rasmussen | 211/135 X |
| 2,901,122 | 8/1959 | Edman | 211/134 |
| 3,102,501 | 9/1963 | Sutherlan | 211/187 X |
| 4,186,666 | 2/1980 | Honickman | 108/111 X |

*Primary Examiner*—Francis K. Zugel
*Assistant Examiner*—Peter A. Aschenbrenner
*Attorney, Agent, or Firm*—Walker & McKenzie

[57] ABSTRACT

An article supporting rack particularly adapted for being attached to a door, e.g., the inner side of a closet door. The device includes a plurality of dowel rods which are supported at either end thereof by being received in selected ones of numerous holes provided in frame members which are attached to the door. The dowel rods may thusly be installed in various arrangements selectively compatible with various articles intended to be supported by the device in an optimum array for easy and ready access thereof. The dowel rods may be arranged to constrain tall or top-heavy articles as well as slender or bulky articles.

7 Claims, 18 Drawing Figures

ARTICLE SUPPORTING RACK

BACKGROUND OF THE INVENTION

1. Field of the Invention

This invention relates to the field of storage racks and is particularly directed towards such storage racks that are specifically intended to be attached to a door particularly the inner side of a closet or pantry door and the like.

2. Description of the Prior Art

The advantages of converting the inner side of a closet or pantry door and the like to a storage rack have been recognized for several decades. See, for example, the U.S. Pat. No. 2,528,807 granted to Whitney on Nov. 7, 1950. However, it will be appreciated by those skilled in the art that one particular disadvantage to the Whitney invention is that particularly tall or top-heavy articles that may be stored on the shelving disclosed by him would not be properly supported since the rather narrow upturned flange is limited in its ability to prevent these type articles from falling from the shelf as the door is swung closed.

Another disadvantage to shelving conforming to the above mentioned patent is that all of the shelves are equal depth, therefore, small items even though they are not particularly tall or top-heavy would still lack adequate support when placed on the shelves. In other words, an ideal arrangement would be to include structure for adjusting the depth of the article supporting rack so that it might be arranged for properly constraining various articles of different sizes and shapes.

In addition, the advantages of utilizing dowel rods as support structure in the construction of article supporting racks has been recognized for many decades. See, for example, U.S. Pat. No. 2,008,748 granted to Crow on July 23, 1935 and U.S. Pat. No. 2,152,192 granted to Hoffman on Mar. 28, 1939. It should be recognized that the latter two patents are specifically directed towards free standing merchandise display racks particularly for displaying shoes. Moreover, none of the above mentioned patents suggests or discloses applicant's device.

SUMMARY OF THE INVENTION

The present invention is directed toward overcoming the disadvantages and problems relative to previous article supporting racks. The article supporting rack of the present invention is particularly adapted for attachment to a door, e.g., the inner side of a closet or pantry door and the like. The device includes a plurality of dowel rods which are supported at either end thereof by being received in selected ones of numerous holes provided in frame members which are attached to the door. The dowel rods may be thusly installed in various arrangements selectively compatible with various articles intended to be supported by the device in an optimum array for easy and ready access thereto.

An important feature of the present invention is that the device may be assembled in such a manner that certain of the dowel rods establish a railing for constraining any such supported articles in a substantially fixed disposition irrespectively of any swinging action which the door may experience.

Another important feature of the present invention is that the depth of the individual rack may be adjustable so that it may be arranged to be fully compatible with various articles of different sizes and shapes. In addition, the invention is not limited to merely having one dowel rod establishing a railing but anticipates using a plurality of dowel rods for constraining particularly tall or top-heavy articles. Thus, the adjustment may be in and out as well as up and down, and may be rearranged as the need arises.

Moreover, the device may optionally include an intermediate frame member which is particularly advantageous in supporting heavy articles. In addition, the intermediate frame member enables the rack to be arranged with a narrow vertical section and a wider vertical section to readily accommodate articles of different sizes.

The articles usually might be supported directly by the dowel rod, i.e., particularly when the articles have a flat bottom. On the other hand, certain articles, e.g., particularly ladies' shoes and the like may tend to fall through the spacing between the dowel rods. Therefore, the present invention may optionally include a horizontally disposed platelike support member for enhancing the effectiveness of the shelf. In other words, the platelike support member overlays the dowel rods and provides an uninterrupted support surface for receiving certain ones of the numerous articles.

Further, a single dowel rod may be arranged between the frame members for supporting men's ties or belts and the like.

DESCRIPTION OF THE PREFERRED EMBODIMENT

Figure 1:
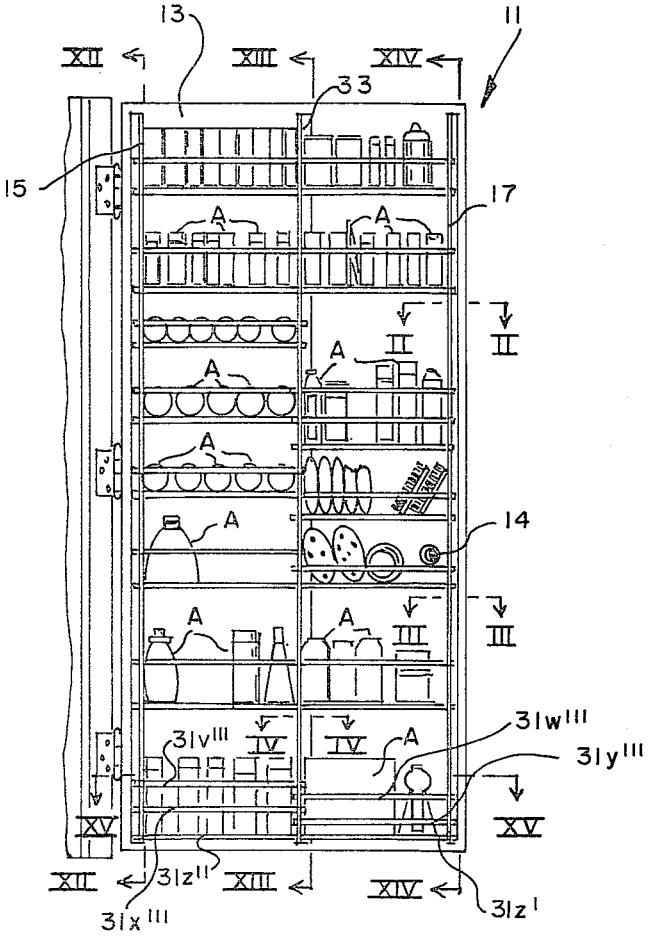
FIG. 1 is a front elevational view of the article support rack of the present invention shown attached to the inner surface of a hinged door.
Figure 4:
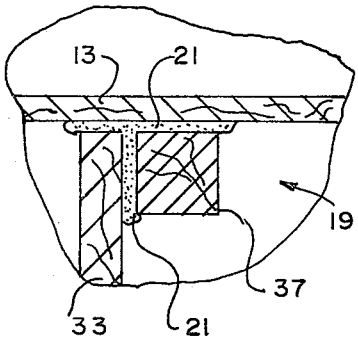
FIG. 4 is an enlarged partial sectional view taken as on the line IV—IV of FIG. 1.
Figure 5:
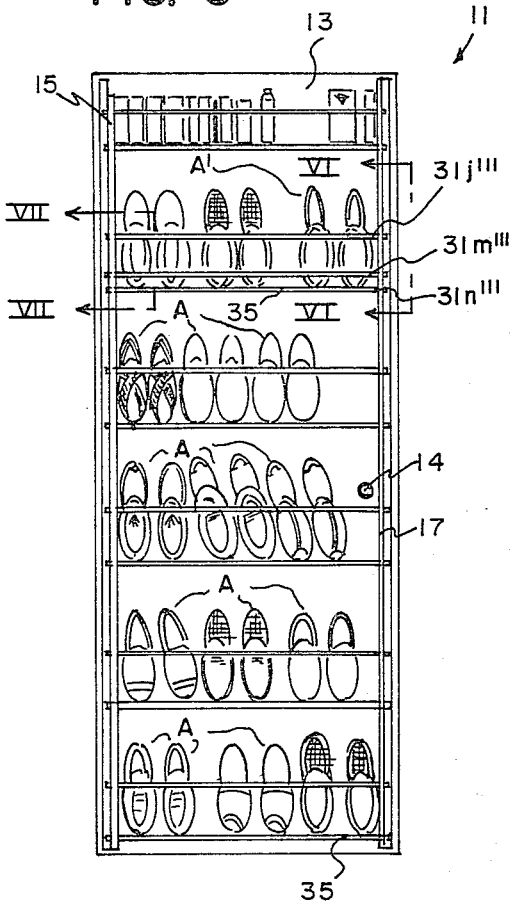
FIG. 5 is another front elevational view of the article supporting rack of the present invention shown arranged differently than that shown in FIG. 1.
Figure 8:
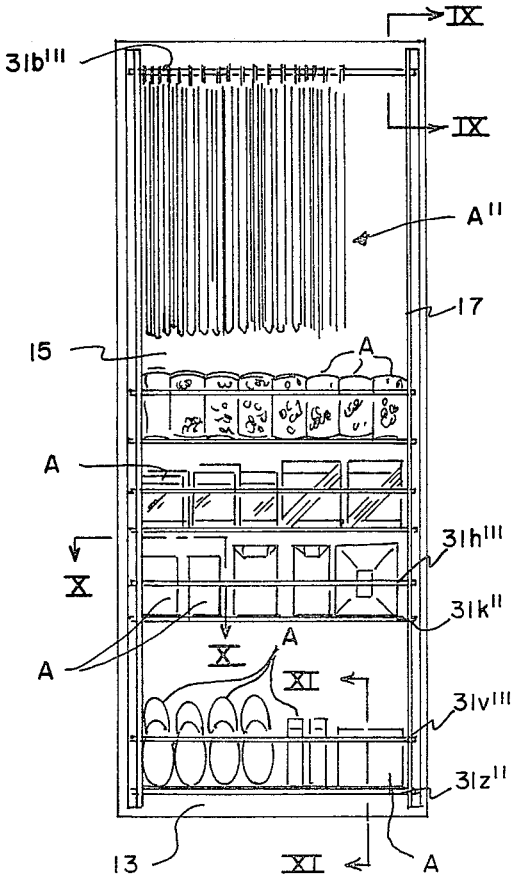
FIG. 8 is still another front elevational view of the article supporting rack of the present invention shown arranged differently than those shown in either FIG. 1 or FIG. 5.

The article supporting rack 11 of the present invention is especially adapted for being attached to a door normally having a door knob, respectively as at 13 and 14 in FIG. 1 of the drawings. The rack 11 is also shown in FIGS. 5 and 8 so as to depict merely a few of the different arrangements that may be readily made up from the rack 11. Therefore, it should be understood that the rack 11 is intended to be compatible with various different sizes and shapes of articles which may conveniently be designated by the letter "A" hereinafter and which will be intended to encompass, but not be limited to, such items as shoes, bottles, cans, boxes and other containers, toys, toilet articles of various descriptions, men's belts and neckties, folded linens such as towels and washcloths and the like, and a multiplicity of other well known household items too numerous to list herein.

The device 11 has been found to be particularly advantageous when installed on the inner side of pantry doors and clothes closet doors and the like. However, other uses of the device 11 are only limited by the imagination of the user. For example, certain individuals may prefer that the rack 11 merely cover the upper half of the door. In this event, the rack 11 may simply be severed in half, thus establishing two half racks which may be installed, e.g., so as to utilize merely the upper half sections of two doors.

The article supporting rack 11 includes at least first and second confrontingly arranged planar rigid frame members, as at 15, 17 respectively as shown in FIGS. 1, 5, and elsewhere in the drawings. Also included are suitable means generally indicated at 19 for attaching the frame members 15, 17 to the door 13. In addition to other structure to be disclosed, the attaching means 19, in some instances, includes adhesive means, as at 21, and nail or screw fastener means, as at 23. However, it should be understood that, if desired, the adhesive means 21 may be deleted, particularly when the door 13 has a solid core or suitable means for receiving the nail or screw fastener means 23. On the other hand, when the door 13 has a hollow core as usually found in present day residences, the adhesive means 21 forms an important part of the attachment means 19.

Figure 6:
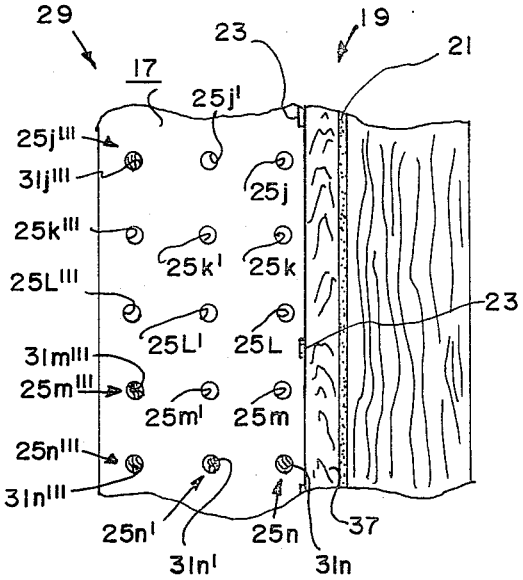
FIG. 6 is an enlarged partial sectional view taken as on the line VI—VI of FIG. 5.
Figure 7:
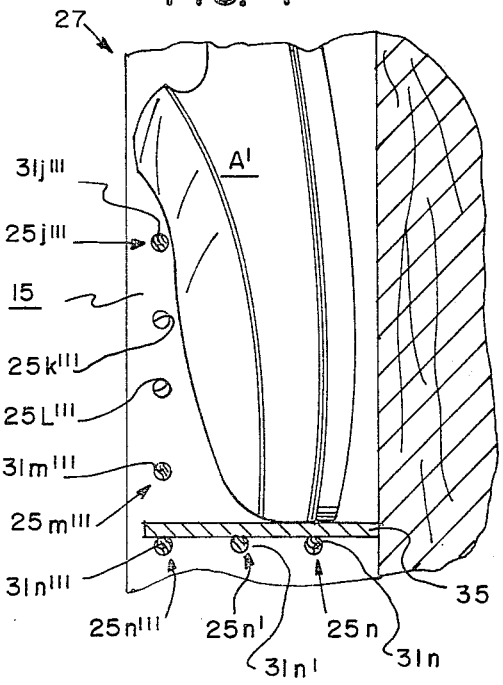
FIG. 7 is an enlarged partial sectional view taken as on the line VII—VII of FIG. 5.
Figure 15:
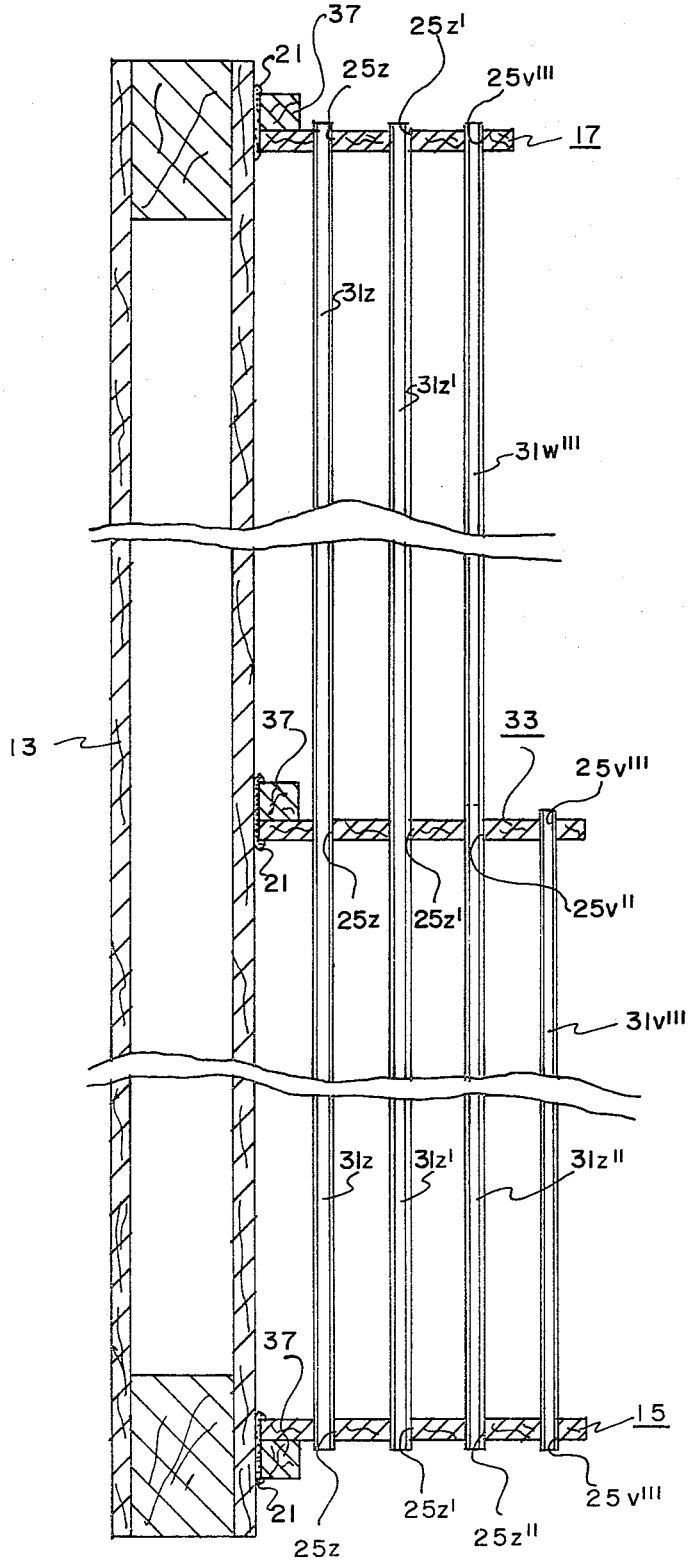
FIG. 15 is an enlarged partial sectional view taken as on the line XV—XV of FIG. 1 with the view being rotated 90°.

From FIG. 15 of the drawings it may be seen that the frame members 15, 17 are substantially perpendicularly disposed with the plane of the door 13 and have an optimum spaced distance therebetween. From FIGS. 6, 9, 15 et al of the drawings, it may be seen that each of the frame members 15, 17 is provided with numerous uniformly sized holes collectively characterized by the numeral 25 and which may hereinafter be individually designated as **25*a*, 25*b*, 25*c*, etc. From FIGS. 5–7 of the drawings it may be seen that the first and second members 15, 17 have co-acting portions generally indicated at 27, 29 respectively, e.g., as shown in FIGS. 6 and 7 of the drawings. These portions 27, 29 co-act in such fashion wherein at least a portion of the holes, e.g., the holes 25*n*, provided in the first frame member 15 are aligned with at least a portion of the holes, e.g., the holes 25*n*, provided in the second frame members 17 so as to establish companion holes. These companion holes will hereinafter be characterized by like suffix letters, e.g., the hole 25*n*, for the portion 27 will have a companion hole 25*n* for the co-acting portion 29. More specifically, the companion holes, e.g., the two holes 25*n***, etc., have a common horizontal axis for reasons about to be disclosed.

The rack 11 also includes a plurality of dowel rods 31 which may individually be designated as **31*a*, 31*b*, 31*c*, etc., which are compatibly sized for a snug fitting relationship selectively with any of the companion holes, e.g., the companion holes 25*n*, etc. Each of the dowel rods 31 has a length which is at least sufficient for spanning the distance between adjacent ones of the frame members, e.g., the frame members 15, 17 as shown in FIGS. 5 and 8 of the drawings. Therefore, the opposite ends of the dowel rods 31 may be received in selected ones of the companion holes, e.g., the companion holes 25*n*, etc. In this fashion, the dowel rods 31 become affixed to the frame members 15, 17. It will be seen as the specification proceeds that the various arrangements of the dowel rods 31 within the companion holes, e.g., the companion holes 25*n*, etc., are selectively compatible with various articles A, thus the dowel rods 31** may selectively be used in supporting such articles A in an optimum array.

Figure 11:
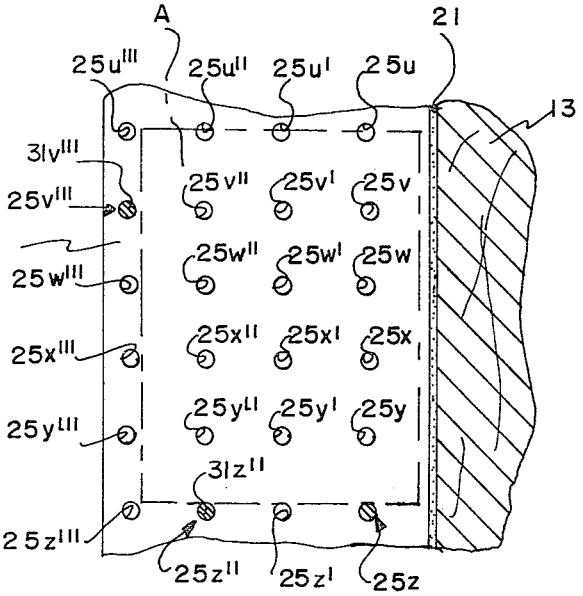
FIG. 11 is an enlarged partial sectional view taken as on the line XI—XI of FIG. 8.
Figure 12:
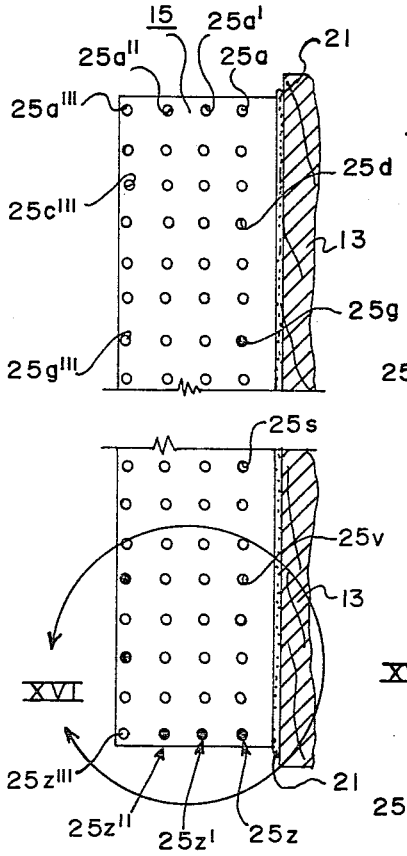
FIG. 12 is an enlarged partial sectional view taken as on the line XII—XII of FIG. 1.
Figure 13:
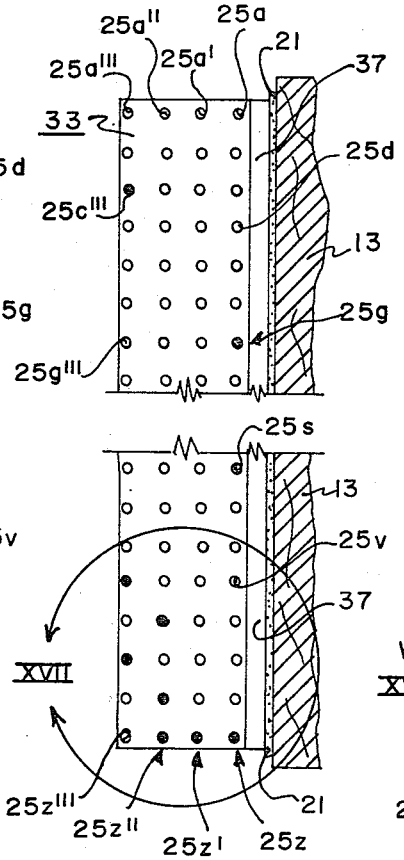
FIG. 13 is an enlarged partial sectional view taken as on the line XIII—XIII of FIG. 1.
Figure 14:
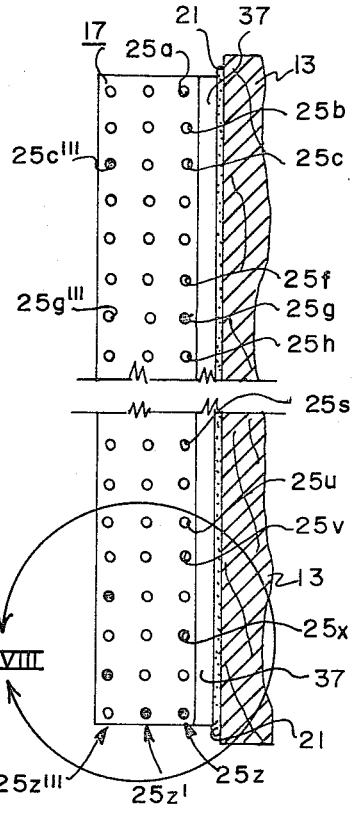
FIG. 14 is an enlarged partial sectional view taken as on the line XIV—XIV of FIG. 1.
Figure 16:
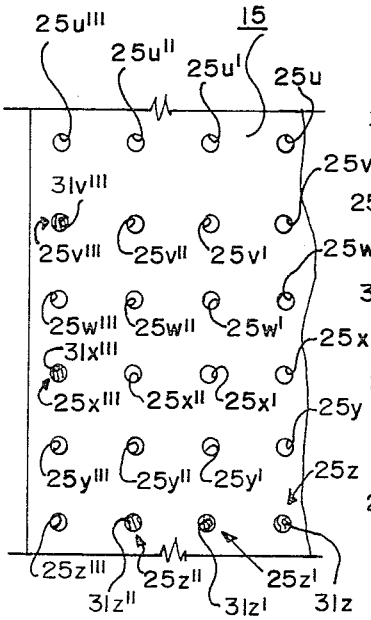
FIGS. 16, 17, and 18 are enlarged partial views respectively taken as on the lines XVI, XVII, and XVIII of FIGS. 12, 13, and 14.
Figure 17:
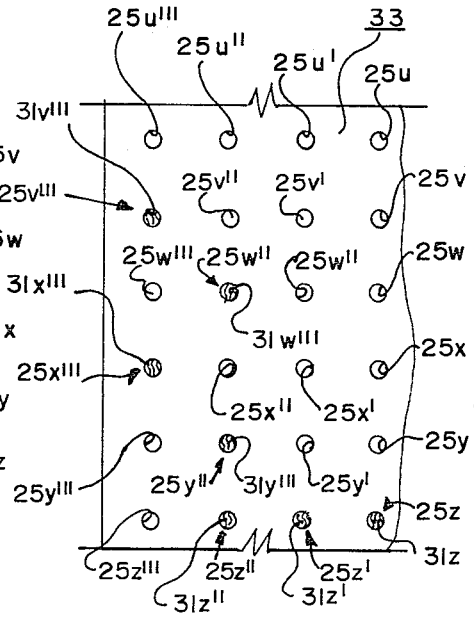
Figure 18:
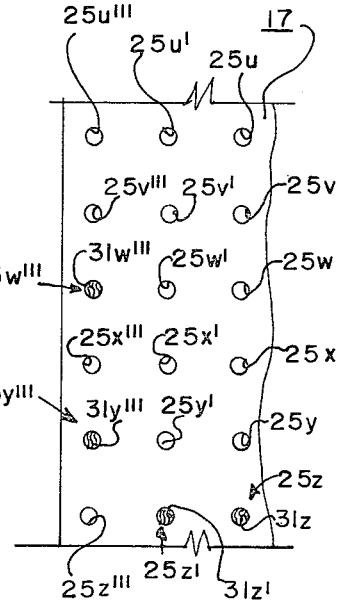

From FIGS. 12–18 et al of the drawings, it may readily be seen that the holes 25 are arranged in at least three vertical rows (or more) thus establishing an inner most row wherein the holes are characterized by the numeral 25 having merely the proper letter suffix as mentioned previously, e.g. **25*a*; an outermost row of holes each having the numeral 25 and the proper letter suffix as mentioned above and further characterized by a triple prime mark, e.g., 25*a*'''; and at least one intermediate row of holes each having the numeral 25 and the proper letter suffix as mentioned previously and further characterized by either a single prime mark or a double prime mark, e.g., 25*a*' or 25*a*''. It should be understood that the holes 25 in some instances may be arranged in merely three vertical rows like that shown in FIGS. 6 and 7 while in other instances they may be arranged in four vertical rows like that shown in FIGS. 9 and 11** and elsewhere.

From FIGS. 5 through 7 of the drawings it may also be seen that at least two of the dowel rods, i.e., the dowel rods **31*n*, 31*n*' and 31*n*'' are disposed in a side-by-side relationship thus establishing a shelf therefrom whereby various articles; e.g., the article which might be shoes, etc. conveniently characterized by the letter A having a prime suffix, thus A'; may be restingly supported thereon. In addition, it may be seen that at least one of the dowel rods, i.e., the dowel rod 31*j*''' is disposed in a pair of companion holes 25*j* which are situated in the outer row, i.e., in this case the frame members 15, 17 only have three rows of holes 25. However, it should be noted that the dowel rod 31*j*''40 is located a spaced distance above those establishing the shelf; i.e., the dowel rods 31*n*, 31*n*', 31*n*''. Furthermore, the dowel rod 31*j*''' establishes a railing for constraining any such supported articles A' in a substantially fixed disposition irrespectively of any swinging action which the door 13** may experience.

From FIGS. 1, 4 and 12 through 18 of the drawings it may be seen that the rack 11 may optionally include at least one intermediate planar rigid frame member, as at 33. The first and second frame members 15, 17 are disposed adjacent the opposite vertical marginal portions of the door 13 with the intermediate frame member 33 being disposed medially therebetween as clearly shown in FIGS. 1 and 15 of the drawings. The intermediate frame member 33 has the first portion of the holes, e.g., the holes **25*z*, 25*z*', 25*z*'', etc., provided therein situated so as to respectively have commonality of alignment with the horizontal axes of an equal number or primary companion holes provided in the first and second frame members 15, 17, i.e., the holes 25***z*, 25*z*′, and 25*z*″ provided therein. Further, at least a first portion of the dowel rods; e.g., the dowel rods 31*z*, 31*z*′ as shown in FIGS. 15 through 18; span the spaced distance between the first and second frame members 15, 17 by having the opposite ends thereof respectively received in the primary companion holes 25*z* and 25*z*′ that have been provided in the first and second frame members 15, 17 and with the medial portions of the first portion of the dowel rods; e.g., the dowel rods 31 and 31*z*′; being respectively received in the first portion of the holes; i.e., the holes 25*z* and 25*z*′; that have been provided in the intermediate frame member 33.

Further observation of FIGS. 12 through 18 will reveal that the first and intermediate frame members 15, 33 are substantially identical one with the other, while the second frame member 17 is conspicuously more narrow vertically than either of the first and intermediate frame members 15, 33. The intermediate frame member 33 has a second portion of the holes, e.g.; the hole 25*v*‴; provided therein situated so as to respectively have commonality of alignment with the horizontal axes of secondary companion holes; e.g., the hole 24*v*‴; provided in merely the first frame member 15. In addition, at least a second portion of the dowel rods; e.g.; the dowel rod 31*v*‴; spans merely the spaced distance between the first and intermediate frame members 15, 33 by having one end thereof received in selected ones of the second portion of the holes that have been provided in the intermediate frame member; e.g., the hole 25*v*‴; and the opposite ends of this second portion of the dowel rods; e.g., the dowel rod 31*v*‴; is/are received in the proper secondary companion holes; e.g., the hole 25*v*‴; that have been provided in the frist frame member 15.

The depth of the frame members 15, 17 and 33 may be of any suitable dimensions (e.g., 3″ for member 17 and 4″ for members 15 and 33), and the reason for having the frame member 17 narrower is as follows: With the frame member 17 (which is adjacent the free edge of the door) being narrow there is no concern about it hitting the edge of the door jamb as the door is opened and closed. Thus, the space between frame members 17 and 33 will accommodate smaller in depth articles, while at the same time the space between frame members 33 and 15 will accommodate the larger in depth articles.

From FIGS. 5 and 7 of the drawings it may be seen that the rack 11 includes at least one horizontally disposed platelike support member, as at 35, for enhancing the effectiveness of the shelf that has been established by the side-by-side situated dowel rods 31*n*, 31*n*′ and 31*n*‴. The horizontally disposed platelike support member 35 which may be formed from cardboard or the like is restingly supported upon the dowel rods 31 that establish the shelf. In this fashion an uninterrupted support surface is provided for receiving certain ones of the numerous articles, e.g., the articles A′, etc.

Figure 9:
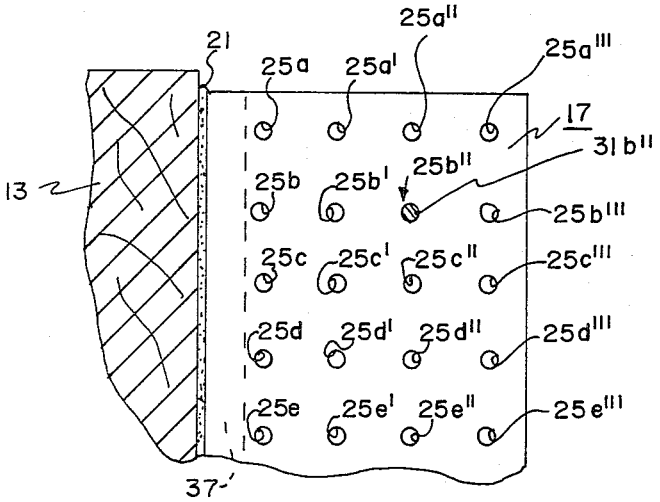
FIG. 9 is an enlarged partial sectional view taken as on the line IX—IX of FIG. 8.
Figure 10:
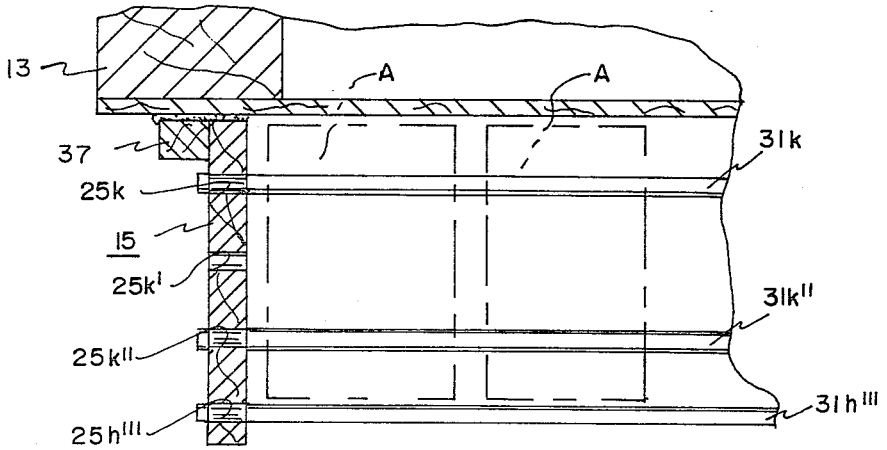
FIG. 10 is an enlarged partial sectional view taken as on the line X—X of FIG. 8.

From FIGS. 8 and 9 of the drawings it may be seen that the rack 11 includes at least one of the dowel rods, e.g., the dowel rod 31*b*″, which is disposed between the first and second frame members 15, 17 so as to function totally independent of any other of the dowel rods 31 in supporting certain selected articles, e.g., the articles A″ which in reality are intended to depict an array of men's articles or belts, etc.

Figure 3:
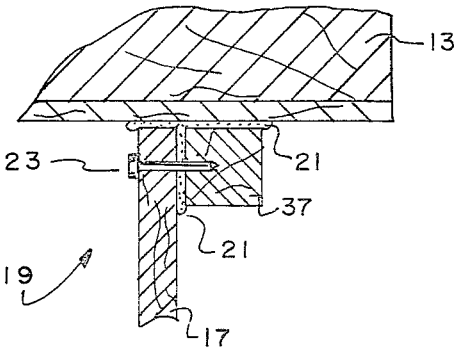
FIG. 3 is an enlarged partial sectional view taken as on the line III—III of FIG. 1.
Figure 2:
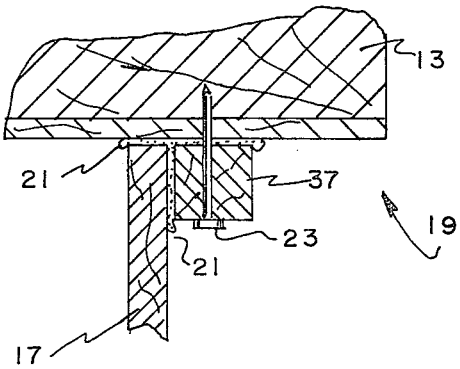
FIG. 2 is an enlarged partial sectional view taken as on the line II—II of FIG. 1.

The attaching means 19 also preferably includes at least one cleat member 37 to facilitate use of the nail or screw fastener means 23 in the manner best shown in FIGS. 2 and 3 of the drawings. However, it should be understood that, if desired, in place of the wood cleat members 37, suitable metal clips, not shown, of known construction may be utilized without departing from the spirit and scope of the present invention.

Although the invention has been described and illustrated with respect to a preferred embodiment thereof, it should be understood that it is not intended to be so limited since changes and modifications may be made therein which are within the full intended scope of the invention.

I claim:

1. An article supporting rack especially adapted for being attached to a door, said article supporting rack comprising first and second confrontingly arranged planar rigid frame members and an intermediate planar rigid frame member, means for attaching said frame members to said door, said frame members being substantially perpendicularly disposed with the plane of said door and having an optimum spaced distance therebetween; each of said frame members being provided with numerous uniformly sized holes, said frame members having co-acting portions wherein at least a portion of said holes provided in said first and second frame members are aligned with at least a portion of said holes provided in said intermediate frame member so as to establish companion holes for said co-acting portions with the companion holes having a common horizontal axis, and a plurality of dowel rods compatibly sized for a snug fitting relationship selectively with any of said companion holes, each of said dowel rods having a length sufficient for spanning the distance between adjacent ones of said frame members as the opposite ends thereof are received in selected ones of said companion holes thus becoming affixed to said frame member, at least one of said dowel rods having a length insufficient for spanning the distance between said first and second frame members, the various arrangements of said dowel rods within said companion holes being selectively compatible with various articles enabling said dowel rods to selectively be used in supporting such articles in an optimum array.

2. The article supporting rack as set forth in claim 1 in which said uniformly sized holes are arranged in at least two vertical rows thus establishing an inner row and an outer row, said dowel rods which may be received within the inner row of companion holes principally being used to restingly support the articles thereon, and said dowel rods which may be received within the outer row of companion holes principally be used as a railing for constraining any such supported articles in a substantially fixed disposition irrespective of any movement which the door may experience.

3. The article supporting rack as set forth in claim 1 in which at least one of said dowel rods is disposed between said first and second frame members so as to function totally independent of any other of said dowel rods in supporting certain selected articles.

4. An article supporting rack especially adapted for being attached to a swingably hinged door having a door knob to enable numerous selected articles of various sizes and shapes to be stored on the inner side of the door, said article supporting rack comprising first and second confrontingly arranged planar rigid frame members and an intermediate planar rigid frame member, means for attaching said frame members to the inner side of the door, said frame members being substantially perpendicularly disposed with the inner surface of the door and having an optimum spaced distance therebetween with said second frame member positioned adjacent the door knob; said frame members being provided with numerous uniformly sized holes arranged in at least three vertical rows thus establishing an outer row, an inner row, and at least one intermediate row; said frame members having co-acting portions wherein at least a portion of said holes provided in said first and second frame members are aligned with at least a portion of said holes provided in said intermediate frame member so as to establish companion holes having a common horizontal axis, and a plurality of dowel rods compatibly sized for a snug fitting relationship selectively with any of said companion holes, each of said dowel rods having a length sufficient for spanning the distance between adjacent ones of said frame members as the opposite ends thereof are received in selected ones of said companion holes thus becoming affixed to said frame members, at least one of said dowel rods having a length insufficient for spanning the distance between said first and second frame members, at least two of said dowel rods being disposed in a side-by-side relationship thus establishing a shelf therefrom whereby various articles may be restingly supported thereon, and with at least one of said dowel rods being disposed in companion holes which are situated in said outer row but at a spaced distance above those establishing the shelf with the latter dowel rod(s) establishing a railing for constraining any such supported articles in a substantially fixed disposition irrespectively of any swinging action which the door may experience.

5. The article supporting rack as set forth in claims 1 or 4 in which said first and second frame members are disposed adjacent the opposite vertical marginal portions of the door with said intermediate frame member being disposed medially therebetween, said intermediate frame member having the first portion of said holes provided therein situated so as to respectively have commonality of alignment with the horizontal axes of an equal number of primary companion holes provided in said first and second frame members, and at least a first portion of said dowel rods spanning the spaced distance between said first and second frame members by having the opposite ends thereof respectively received in the primary companion holes that have been provided in said first and second frame members and with the medial portions of said first portion of said dowel rods being respectively received in said first portion of said holes that have been provided in said intermediate frame member.

6. The article supporting rack as set forth in claim 5 in which said first and intermediate frame members are substantially identical one with the other, and in which said second frame member is conspicuously more narrow in depth than either of said first and said intermediate frame members, said intermediate frame member having a second portion of said holes provided therein situated so as to respectively have commonality of alignment with the horizontal axes of secondary companion holes provided in merely said first frame member, and at least a second portion of said dowel rods spanning merely the spaced distance between said first and said intermediate frame members by having one end thereof received in selected ones of said second portion of said holes that have been provided in said intermediate frame member and the opposite ends of said second portion of said dowel rods being received in said secondary companion holes that have been provided in said first frame members.

7. The article supporting rack as set forth in claim 4 in which is included at least one horizontally disposed platelike support member for enhancing the effectiveness of said shelf that has been established by said side-by-side dowel rods, said horizontally disposed platelike support member being restingly supported upon said dowel rods that establish said self thus providing an uninterrupted support surface for receiving certain ones of the numerous articles.

* * * * *